US005469719A

United States Patent [19]

Imai et al.

[11] Patent Number: 5,469,719

[45] Date of Patent: Nov. 28, 1995

[54] FULL AUTOMATIC WASHING MACHINE

[75] Inventors: Tooru Imai, Tajimi; Satoru Matsumoto, Seto; Kiyoshi Okazaki, Seto; Yuji Nagata, Seto, all of Japan

[73] Assignee: Kabushiki Kaisha Toshiba, Kawasaki, Japan

[21] Appl. No.: 219,794

[22] Filed: Mar. 28, 1994

[30] Foreign Application Priority Data

Mar. 26, 1993 [JP] Japan ..... 5-068207
May 26, 1993 [JP] Japan ..... 5-124128

[51] Int. Cl.[6] ..... D06F 33/02

[52] U.S. Cl. ..... 68/12.04; 68/12.02; 68/12.12; 68/12.19; 68/23.5

[58] Field of Search ..... 68/12.02, 12.04, 68/12.12, 12.19, 23.5

[56] References Cited

U.S. PATENT DOCUMENTS 4,779,430 10/1988 Thuruta et al. ..... 68/12.04
5,241,895 9/1993 Ishibashi et al. ..... 68/12.04 X
5,297,307 3/1994 Baek ..... 68/12.04 X

FOREIGN PATENT DOCUMENTS 0051491 5/1982 European Pat. Off. .
139291 7/1985 Japan ..... 68/12.02
77495 4/1988 Japan ..... 68/12.04
2244149 11/1991 United Kingdom ..... 68/12.04

*Primary Examiner*—Philip R. Coe
*Attorney, Agent, or Firm*—Cushman Darby & Cushman

[57] ABSTRACT

A full automatic washing machine includes an outer tub, a rotatable tub rotatably mounted in the outer tub, an agitator rotatably mounted in the rotatable tub and an electric motor for driving the rotatable tub and the agitator. The volume of clothes accommodated in the rotatable tub is detected. A control circuit controls either a stored-water rinse mode in which the clothes are rinsed with water being stored in the rotatable tub or a rinse-with-dehydration mode in which the clothes are rinsed and dehydrated with the water supplied into the rotatable tub. The stored-water rinse mode is selected when the detected volume of clothes is large. The rinse-with-dehydration mode is selected when the detected volume is small.

17 Claims, 17 Drawing Sheets

| VOLUME OF CLOTHES(Kg) | CLOTH QUALITY | CONTROL CONTENTS | | | | | | |
|---|---|---|---|---|---|---|---|---|
| 5~4. 1 | STIFF STANDARD SOFT | WASH | DRAINAGE | INTERMEDIATE DEHYDRATION | RINSE-WITH-DEHYDRATION (FOUR TIMES) | WATER -STORED RINSE | DRAINAGE | FINAL DEHYDRATION |
| 4~3. 1 | STIFF STANDARD | WASH | DRAINAGE | INTERMEDIATE DEHYDRATION | RINSE-WITH-DEHYDRATION (FOUR TIMES) | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (THEREE TIMES) | WATER -STORED RINSE | DRAINAGE | FINAL DEHYDRATION |
| 3~2. 1 | STIFF STANDARD | WASH | DRAINAGE | INTERMEDIATE DEHYDRATION | RINSE-WITH-DEHYDRATION (THEREE TIMES) | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (TWICE) | WATER -STORED RINSE | DRAINAGE | FINAL DEHYDRATION |
| 2~1 | STIFF STANDARD SOFT | WASH | DRAINAGE | INTERMEDIATE DEHYDRATION | RINSE-WITH-DEHYDRATION (TWICE) | WATER -STORED RINSE | DRAINAGE | FINAL DEHYDRATION |

| CONTROL PATTERN | VOLUME OF CLOTHES(Kg) | CONTROL CONTENTS | | | | | | | | | WATER-SUPPLY PERIOD PER RINSE-WITH-DEHYDRATION |
|---|---|---|---|---|---|---|---|---|---|---|---|
| A | 6～5. 1 | WASH | DRAINAGE | INTERMEDIATE DEHYDRATION | FIRST WATER -STORED RINSE | DRAINAGE | INTERMEDIATE DEHYDRATION | SECOND WATER -STORED RINSE | DRAINAGE | FINAL DEHYDRATION | |
| B1 | 5～4. 1 | WASH | DRAINAGE | INTERMEDIATE DEHYDRATION | RINSE-WITH-DEHYDRATION (FOUR TIMES) | | | WATER -STORED RINSE | DRAINAGE | FINAL DEHYDRATION | 68～54 (SEC.) |
| B2 | 4～2. 1 | WASH | DRAINAGE | INTERMEDIATE DEHYDRATION | RINSE-WITH-DEHYDRATION (THEREE TIMES) | | | WATER -STORED RINSE | DRAINAGE | FINAL DEHYDRATION | 72～36 |
| B3 | 2～1 | WASH | DRAINAGE | INTERMEDIATE DEHYDRATION | RINSE-WITH-DEHYDRATION (TWICE) | | | WATER -STORED RINSE | DRAINAGE | FINAL DEHYDRATION | 54～27 |

FIG. 3

| DEGREE OF SOILING | VOLUME OF CLOTHES | CONTROL CONTENTS | | | | | | | | |
|---|---|---|---|---|---|---|---|---|---|---|
| LARGE MEDIUM | LARGE MEDIUM | WASH | DRAINAGE | INTERMEDIATE DEHYDRATION | FIRST WATER -STORED RINSE | DRAINAGE | INTERMEDIATE DEHYDRATION | SECOND WATER -STORED RINSE | DRAINAGE | FINAL DEHYDRATION |
| LARGE MEDIUM | SMALL | WASH | DRAINAGE | INTERMEDIATE DEHYDRATION | RINSE-WITH-DEHYDRATION | | | WATER -STORED RINSE | DRAINAGE | FINAL DEHYDRATION |
| SMALL | LARGE MEDIUM SMALL | | | | | | | | | |

FIG. 11

| VOLUME OF CLOTHES(Kg) | CLOTH QUALITY | CONTROL CONTENTS | | | | | | |
|---|---|---|---|---|---|---|---|---|
| 5～4. 1 | STIFF STANDARD SOFT | WASH | DRAINAGE | INTERMEDIATE DEHYDRATION | RINSE-WITH-DEHYDRATION (FOUR TIMES) | WATER -STORED RINSE | DRAINAGE | FINAL DEHYDRATION |
| 4～3. 1 | STIFF STANDARD | WASH | DRAINAGE | INTERMEDIATE DEHYDRATION | RINSE-WITH-DEHYDRATION (FOUR TIMES) | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (THEREE TIMES) | WATER -STORED RINSE | DRAINAGE | FINAL DEHYDRATION |
| 3～2. 1 | STIFF STANDARD | WASH | DRAINAGE | INTERMEDIATE DEHYDRATION | RINSE-WITH-DEHYDRATION (THEREE TIMES) | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (TWICE) | WATER -STORED RINSE | DRAINAGE | FINAL DEHYDRATION |
| 2～1 | STIFF STANDARD SOFT | WASH | DRAINAGE | INTERMEDIATE DEHYDRATION | RINSE-WITH-DEHYDRATION (TWICE) | WATER -STORED RINSE | DRAINAGE | FINAL DEHYDRATION |

FIG.15

| VOLUME OF CLOTHES(Kg) | CLOTH QUALITY | CONTROL CONTENTS | | | | | | | | |
|---|---|---|---|---|---|---|---|---|---|---|
| 6～4. 1 | STIFF STANDARD | WASH | DRAINAGE | INTERMEDIATE DEHYDRATION | FIRST WATER -STORED RINSE | DRAINAGE | INTERMEDIATE DEHYDRATION | SECOND WATER -STORED RINSE | DRAINAGE | FINAL DEHYDRATION |
| | SOFT | WASH | DRAINAGE | INTERMEDIATE DEHYDRATION | RINSE-WITH-DEHYDRATION (FOUR TIMES) | | | WATER -STORED RINSE | DRAINAGE | FINAL DEHYDRATION |
| 4～3. 1 | STIFF STANDARD | WASH | DRAINAGE | INTERMEDIATE DEHYDRATION | RINSE-WITH-DEHYDRATION (FOUR TIMES) | | | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (THEREE TIMES) | | | WATER -STORED RINSE | DRAINAGE | FINAL DEHYDRATION |
| 3～2. 1 | STIFF STANDARD | WASH | DRAINAGE | INTERMEDIATE DEHYDRATION | RINSE-WITH-DEHYDRATION (THEREE TIMES) | | | WATER -STORED RINSE | DRAINAGE | FINAL DEHYDRATION |
| | SOFT | WASH | DRAINAGE | INTERMEDIATE DEHYDRATION | RINSE-WITH-DEHYDRATION (TWICE) | | | WATER -STORED RINSE | DRAINAGE | FINAL DEHYDRATION |
| 2～1 | STIFF STANDARD SOFT | WASH | DRAINAGE | INTERMEDIATE DEHYDRATION | RINSE-WITH-DEHYDRATION (TWICE) | | | WATER -STORED RINSE | DRAINAGE | FINAL DEHYDRATION |

FIG.18

FULL AUTOMATIC WASHING MACHINE

BACKGROUND OF THE INVENTION

1. Field of the Invention

This invention relates to an improvement in efficiency of a rinse operation in a full automatic washing machine.

2. Description of the Prior Art

Wash, rinse and dehydration operations are automatically executed sequentially in full automatic washing machines. The prior art has provided for various improvements in the reduction of an amount of water used for the washing operation and shortening of the operating time period of the machine. However, a sufficient reduction in the amount of used water and a sufficient shortening of the operating time period have not been achieved. In particular, the rinse operation requires a large amount of water and a long operation time period in the whole operation of the washing machine. Accordingly, there is a problem of how to reduce both the amount of used water and the operation time period in the rinse operation with the effect of rinsing maintained at a high level.

SUMMARY OF THE INVENTION

Therefore, an object of the present invention is to provide a full automatic washing machine wherein the amount of used water and the operation time period in the rinse operation can be reduced with the rinsing effect maintained at the high level, thereby achieving saving in the used water and reduction in the whole operation time period.

The present invention relies upon the following findings. The rinse operation includes two modes, that is, a stored-water rinse wherein clothes are rinsed with the water being stored in a rotatable tub and a rinse-with-dehydration wherein the clothes are rinsed and dehydrated with the water being supplied into the rotatable tub during the rinse operation. The stored-water rinse further includes a first or normal mode wherein a predetermined amount of water is stored in the rotatable tub and the rinse operation is performed only with the stored water and a second or overflow mode wherein the predetermined amount of water is stored in the rotatable tub and the water is successively supplied into the rotatable tub. In each of these modes, the amount of used water is large though occurrence of unevenness in the rinsing effect is less. On the other hand, the rinse-with-dehydration has a defect that the occurrence of unevenness in the rinsing effect is much though the amount of used water is small. The inventors made various experiments and have found that whether the clothes are well rinsed or not or whether the unevenness in the rinsing effect occurs or not is closely related to the volume of clothes to be washed and the degree of soiling of the clothes. More specifically, the stored-water rinse is suitable from the point of view of the rinsing effect when the volume of clothes is large. When the volume of clothes to be washed is small, a sufficient rinsing effect can be achieved even in the rinse-with-dehydration. Consequently, the amount of used water and the operation time period in the rinse operation can be reduced with the rinsing effect maintained at the high level when the rinse-with-dehydration is executed for small volume of clothes. An amount of detergent is increased when the degree of soiling of the clothes is high. Since the detergent needs to be removed from the clothes in this case, the stored-water rinse is suitable. The amount of detergent is decreased as the degree of soiling of the cloths becomes lower. In this case, a sufficient rinsing effect can be achieved even in the rinse-with-dehydration. Consequently, the amount of used water and the operation time period in the rinse operation can be reduced with the rinsing effect maintained at the high level when the rinse-with-dehydration is executed for the clothes whose degree of soiling is low.

The present invention provides a full automatic washing machine comprising an outer tub, a rotatable tub rotatably mounted in the outer tub, an agitator rotatably mounted in the rotatable tub and an electric motor for driving the rotatable tub and the agitator. The full automatic washing machine further comprises clothes volume detecting means for detecting volume of clothes accommodated in the rotatable tub. Rinse control means is provided for controlling either a stored-water rinse mode wherein the clothes are rinsed with water being stored in the rotatable tub or a rinse-with-dehydration mode wherein the clothes are rinsed and dehydrated with the water being supplied into the rotatable tub. Operation selecting means is provided for selecting the stored-water rinse mode when the volume of clothes detected by the clothes volume detecting means is large or the rinse-with-dehydration mode when the volume of clothes detected by the clothes volume detecting means is small.

According to the above-described washing machine, the stored-water rinse mode is selected to be executed when the volume of clothes to be washed is large. When the volume of clothes is small, the rinse-with-dehydration mode is selected to be executed. Consequently, the amount of used water and the operation time period in the rinse operation can be reduced while the rinsing effect can be maintained at the high level.

Soiling degree detecting means may be provided for detecting a degree of soiling of the clothes accommodated in the rotatable tub instead of the above-described clothes volume detecting means. The stored-water rinse mode is automatically selected when the degree of soiling of the clothes detected by the clothes soiling degree detecting means is high. When the detected soiling degree is low, the rinse-with-dehydration mode is automatically selected. In this arrangement, too, the amount of used water and the operation time period in the rinse operation can be reduced while the rinsing effect can be maintained at the high level.

The washing machine may be provided with both of the above-described clothes volume detecting means and the soiling degree detecting means may be provided. Either the stored-water rinse mode or the rinse-with-dehydration mode is automatically selected on the basis of the results of detection of the clothes volume detecting means and the soiling degree detecting means. In this arrangement, too, the amount of used water and the operation time period in the rinse operation can be reduced while the rinsing effect can be maintained at the high level.

The full automatic washing machine may further comprise repeat times setting means for setting the number of times of repeat of a rinse-with-dehydration operation on the basis of the results of detection of the clothes volume detecting means or of the soiling degree detecting means when the rinse-with-dehydration mode is selected by the operation mode selecting means. In this arrangement, the amount of used water and the operation time period can be adjusted more accurately according to the detected amount or degree of soiling of clothes. Consequently, further reduction in the amount of used water and the operation time period can be achieved.

The full automatic washing machine may further comprise supplied water amount setting means for setting an amount of water supplied for the rinse-with-dehydration operation on the basis of the results of detection of the clothes volume detecting means or of the soiling degree detecting means when the rinse-with-dehydration mode is selected by the operation mode selecting means. The amount of used water can be adjusted more accurately according to the detected amount or degree of soiling of clothes. Furthermore, the water-supply time period can also be shortened when the amount of supplied water is small. Consequently, the whole operation time period of the washing machine can be further shortened.

The rinse control means may control the water supply in the rinse-with-dehydration operation so that the water is supplied into the rotatable tub while a rotational speed of the rotatable tub is in a low dehydration speed range. Since the water supplied in the rinse-with-dehydration operation soaks sufficiently into the clothes, the rinsing performance can be improved. Furthermore, the rinse control means may control a rotational speed of the rotatable tub in the rinse-with-dehydration operation so that the rotational speed of the rotatable tub is successively increased from a low speed to a high speed. In this arrangement, reduction in oscillation and noise produced during the operation in the rinse-with-dehydration operation can be achieved. Additionally, the washing machine may further comprise rotational speed setting means for setting a rotational speed of the rotatable tub at the time of the water supply during the rinse-with-dehydration operation on the basis of the results of detection of the clothes volume detecting means or the soiling degree detecting means when the rinse-with-dehydration mode is selected by the operation mode selecting means. The rinsing effect can be further improved in this arrangement.

The washing machine may further comprise water-supply flow rate detecting means for detecting a flow rate of water supplied into the rotatable tub per unit period and water-supply control means setting a time period of a water supplying operation during the rinse-with-dehydration operation in accordance with the results of detection of the water-supply flow rate detecting means. The water used in the operation in the rinse-with-dehydration operation can be controlled to be a proper amount which is neither too much nor too less while a sufficient rinsing effect can be achieved. Furthermore, the water-supply control means may select either a pattern of a continuous water-supply mode or a pattern of an intermittent water-supply mode wherein the water-supply mode is changed, in the rinse-with-dehydration operation in accordance with the results of detection of the water-supply flow rate detecting means. In this arrangement, too, the water used in the operation in the rinse-with-dehydration operation can be controlled to be a proper amount which is neither too much nor too less while the water supply can be maintained at an approximately fixed time period.

The washing machine may further comprise cloth quality determining means for determining cloth quality of the clothes accommodated in the rotatable tub and repeat times setting means for setting the number of times of repeat of the rinse-with-dehydration operation on the basis of the results of determination of the cloth quality determining means. Since the rinse-with-dehydration operation can be executed at the number of times suitable for the determined cloth quality, the whole period of the operation of the washing machine can be reduced according to the cloth quality of the clothes to be washed. Furthermore, supplied water amount setting means may further be provided for setting an amount of water supplied for the rinse-with-dehydration operation on the basis of the results of determination of the cloth quality determining means. Since the amount of water supplied during the rinse-with-dehydration operation is determined according to the determined cloth quality of the clothes, sufficient rinsing effect can be achieved and supply of an excess amount of water can be prevented. Additionally, rotational speed setting means may be provided for setting a rotational speed of the rotatable tub at the time of the water supply during the rinse-with-dehydration operation on the basis of the results of determination of the cloth quality determining means. Since the rotational speed of the rotatable tub in the rinse-with-dehydration operation is determined according to the cloth quality of the clothes, rotation of the rotatable tub at an excessively high speed can be prevented and accordingly, damage in the clothes due to washing and waste of electric power can be prevented.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 3 is a graph showing the relation between the volume of clothes and control contents;

FIG. 11 is a graph showing control contents in the second embodiment;

FIG. 15 is a view similar to FIG. 3 showing the fifth embodiment;

FIG. 18 is a view similar to FIG. 3 showing a sixth embodiment of a full automatic washing machine.

DESCRIPTION OF THE PREFERRED EMBODIMENTS

Figure 1:
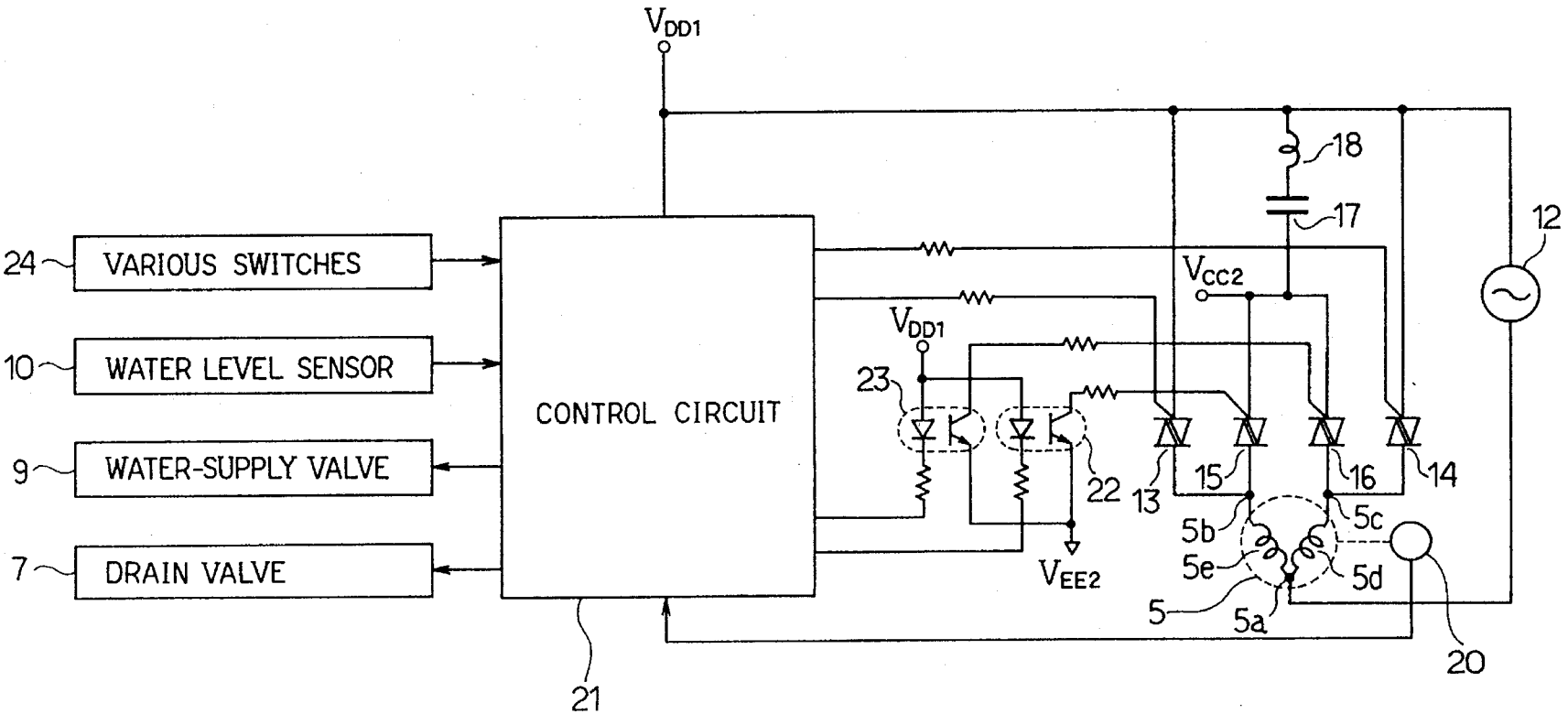
FIG. 1 is an electrical circuit diagram of a first embodiment of a full automatic washing machine in accordance with the present invention.

A first embodiment of the present invention will be described with reference to FIGS. 1 to 5. Referring first to FIG. 2, a full automatic washing machine comprises an outer casing 1 and a water-receiving tub or outer tub 2 enclosed in the outer casing 1. A rotatable tub 3 is rotatably mounted in the water-receiving tub 2 to serve both as a wash tub and a dehydrating tub. An agitator 4 is rotatably mounted on the inner bottom of the rotatable tub 3. A washing machine motor 5 comprising a single-phase induction motor and a drive mechanism 6 therefor are provided on the outer bottom of the water-receiving tub 2. The water-receiving tub 2 has a drain hole formed in its bottom and connected through a drain valve 7 to a drain hose. The motor 5 is driven in a wash operation and a dehydrating operation. Rotational force of the motor 5 is reduced by the drive mechanism 6 to be transmitted only to the agitator 4 in a wash operation. On the other hand, the rotational force of the motor 5 is transmitted by the drive mechanism 6 both to the rotatable tub 3 and to the agitator 4 to rotate them at a high speed in a dehydrating operation. Either a wash or a dehydrating operation is selected. A top cover 8 is mounted on the top of the outer casing 1. A water-supply valve 9 is disposed at the rear inside of the top cover 8. A water level sensor 10 is also disposed at the rear inside of the top cover 8 for sensing the water level in the rotatable tub 3, thereby generating a detection signal indicative of the sensed water level. A control unit 11 is provided at the front inside of the top cover 8.

Figure 2:
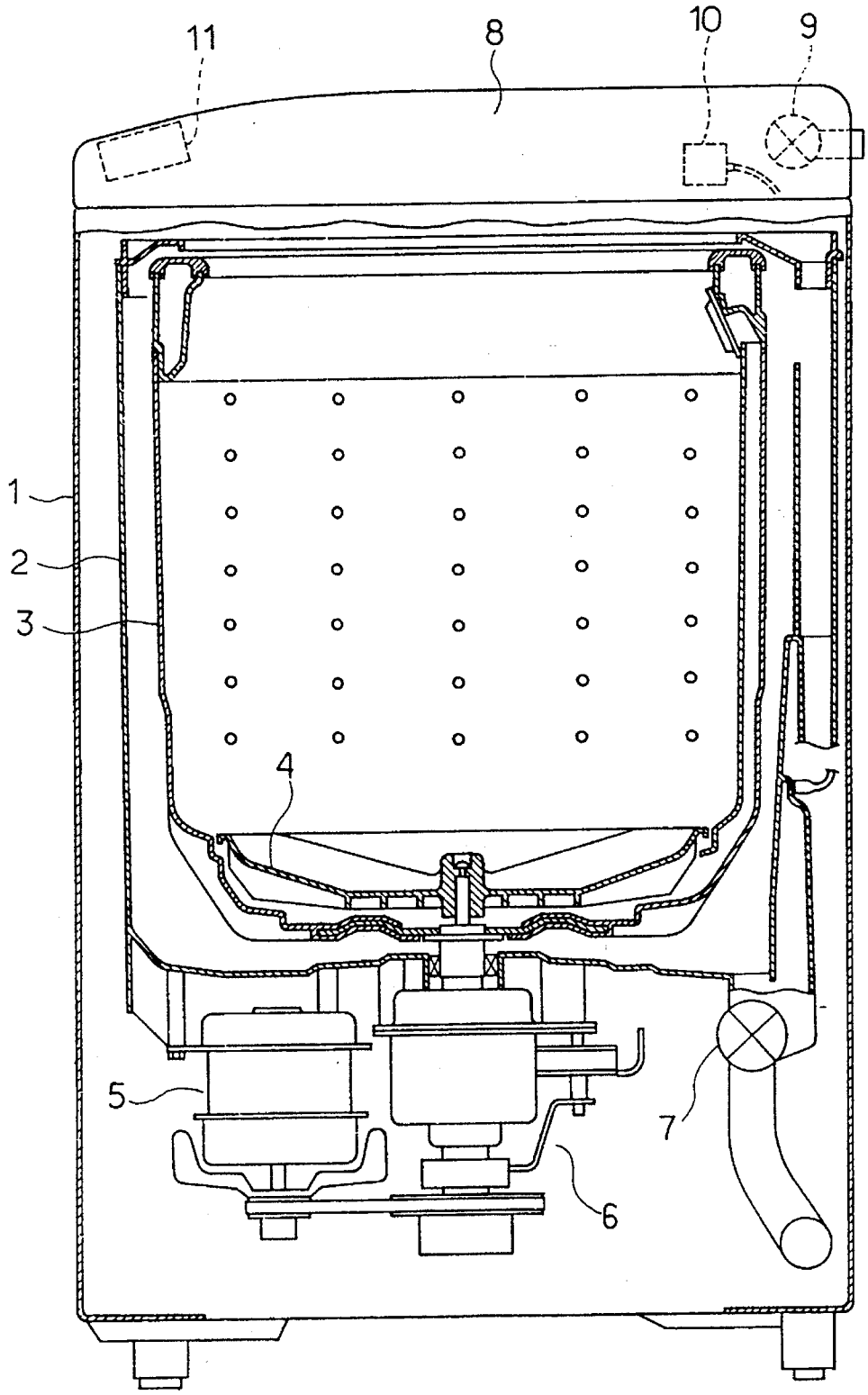
FIG. 2 is a longitudinally side sectional view of the washing machine.

Referring now to FIG. 1, the motor 5 has two windings **5*d* and 5*e*. A connecting terminal 5*a* common to the windings 5*d*, 5*e* is connected to one terminal of an AC power supply 12. The other terminals 5*b* and 5*c* of the respective windings 5*d*, 5*e* are connected through respective triacs 13 and 14 to the other terminal of the AC power supply 12. One ends of triacs 15 and 16 are connected to the terminals 5*b*, 5*c* of the windings 5*d*, 5*e*, respectively. The other ends of the triacs 15, 16 are connected through a common phase advance capacitor 17 and a common coil 18 to said other end of the AC power supply 12. Output switching means 19 is composed of the triacs 13–16. Rotational speed detecting means 20 comprising a Hall element is provided in the motor 5 for detecting the rotational speed thereof. Upon detection of the rotational speed of the motor 5, the rotational speed deflecting means 20 generates a detection signal indicative of the detected rotational speed, which detection signal is supplied to a control circuit 21**.

The control circuit 21 comprises a microcomputer, gate circuits and analog-to-digital (A/D) converter. The triacs 13, 14 are controlled by the control circuit 21 to be turned on and off. The triacs 15, 16 are controlled through respective photo couplers 22 and 23 to be turned on and off. The motor 5 is energized in any one of a first mode wherein all coils are energized, a second mode wherein a main coil is energized, and a third mode wherein an auxiliary coil is energized, by on-off patterns of the triacs 13–16. The following TABLE 1 shows the relation between on-off patterns of the triacs 13–16 and the above-mentioned energization modes.

TABLE 1

Relation between triacs and energization modes

| | Triac | | | |
|---|---|---|---|---|
| Energization mode | 13 | 14 | 15 | 16 |
| All coils | On | Off | Off | On |
| Main coil | On | Off | Off | Off |
| Auxiliary coil | Off | Off | Off | On |

In the first mode wherein all the coils are energized, the triacs 13 and 16 are turned on and the triacs 14 and 15 are turned off so that the coil **5*e* of the motor 5 is energized directly from the AC power supply 12 without use of the phase advance capacitor 17 and the coil 18 while the other coil 5*d* is energized through the phase advance capacitor 17 and the coil 18. In the second mode wherein the main coil is energized, only the triac 13 is turned on so that only the coil 5*e* is energized directly from the AC power supply 12 without use of the phase advance capacitor 17 and the coil 18. In the third mode wherein the auxiliary coil is energized, the triac 16 is turned on so that only the coil 5*d* is energized through the phase advance capacitor 17 and the coil 18. Switch signals generated by various switches 24 provided in an operation panel (not shown) are supplied to the control circuit 21. The detection signals generated by the water level sensor 10 and the rotational speed detecting means 20 are also supplied to the control circuit 21. Based on the supplied signals, the control circuit 21 controls wash, rinse and dehydration operations in accordance with an operation program stored therein. The control circuit 21** serves as clothes volume detecting means, rinse operation control means, operation mode selecting means, repeat times setting means and water-supply amount setting means, as will be described later.

The clothes volume detecting means will first be described. Prior to initiation of the wash operation, a predetermined amount of water is supplied into the rotatable tub 3 and then, the motor 5 is energized in the first mode wherein all the coils are energized. The rotational speed of the motor 5 is determined on the basis of the detection signal from the rotational speed detecting means 20. The volume of clothes is detected in accordance with the determined rotational speed. This manner of detecting the clothes volume is based on an experimental fact that load applied to the motor 5 is increased and accordingly, the rotational speed thereof is decreased as the volume or weight of clothes becomes larger. In the embodiment, four ranges of the clothes volume are employed, that is, a first range between 6 and 5.1 kg, the range corresponding to the case where the clothes volume is below 6 kg and 5 kg or more, a second range between 5 and 4.1 kg, the range corresponding to the case where the clothes volume is below 5 kg and 4 kg or more, a third range between 4 and 2.1 kg, the range corresponding to the case where the clothes volume is below 4 kg and 2 kg or more, and a fourth range between 2 and 1 kg, the range corresponding to the case where the clothes volume is below 2 kg and 1 kg or more.

Figure 4:
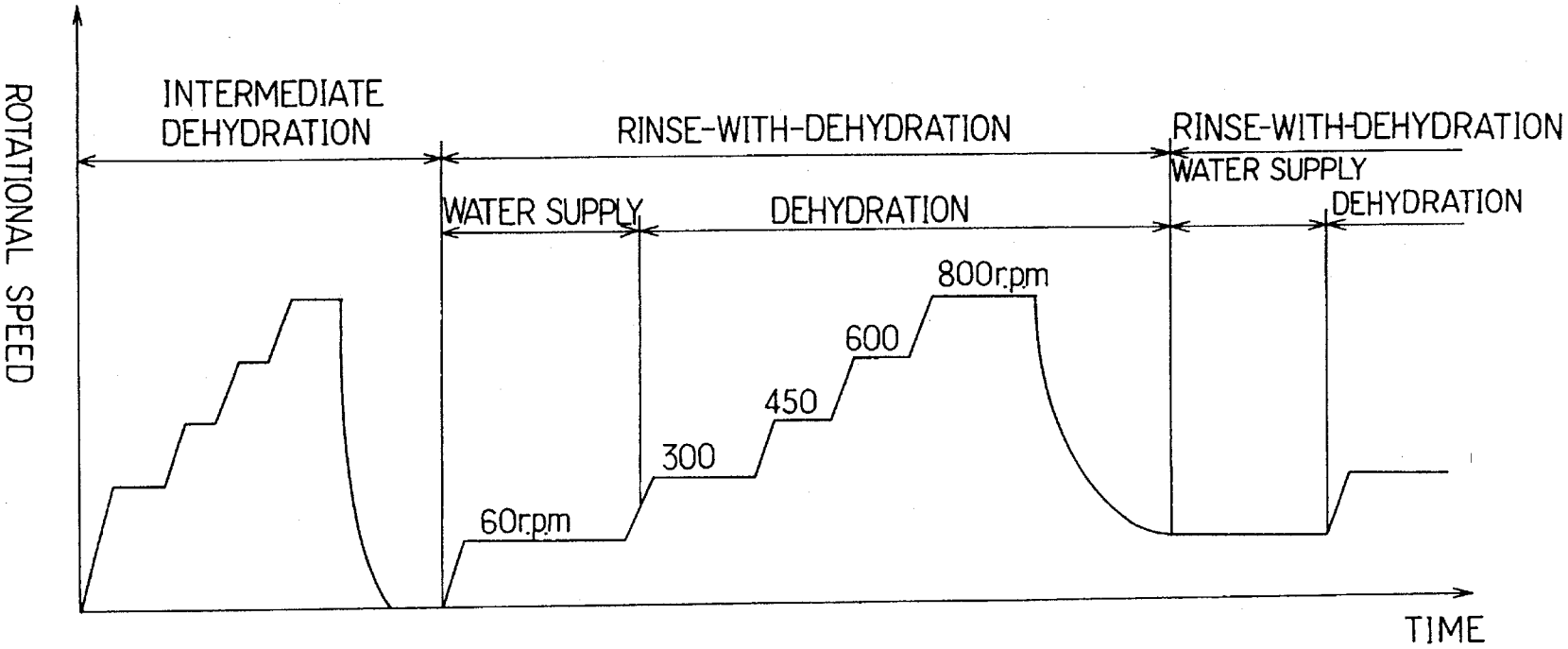
FIG. 4 is a graph showing changes in the rotational speed of a rotatable tub in an intermediate dehydration and the rinse-with-dehydration.
Figure 5:
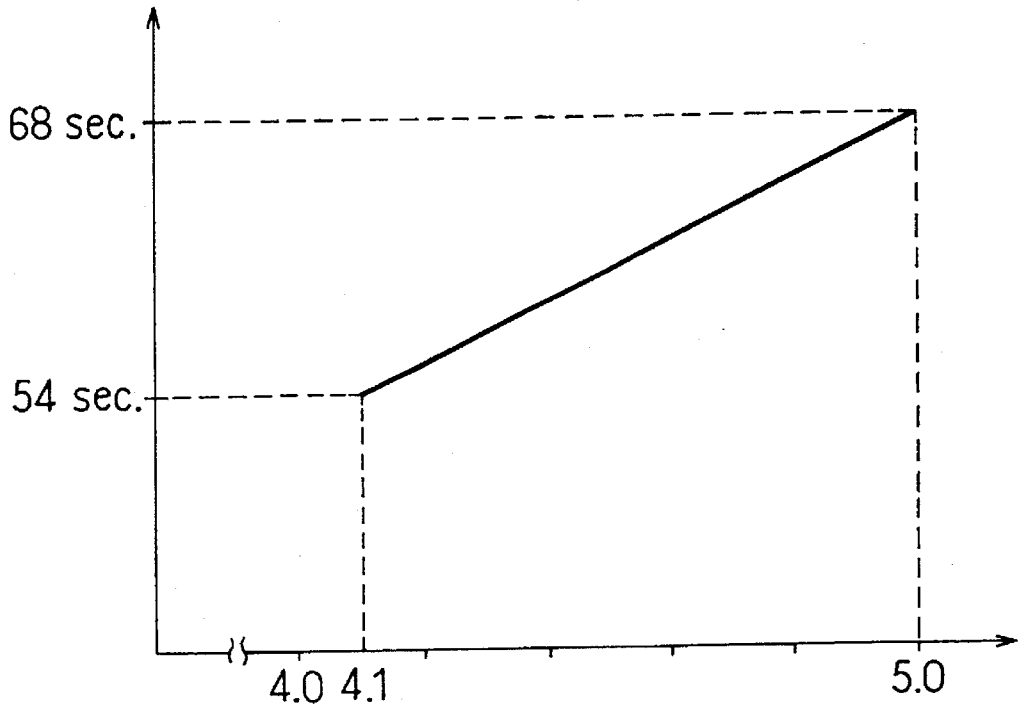
FIG. 5 is a graph showing the relation between the volume of clothes and a water-supply time period.
Figure 6:
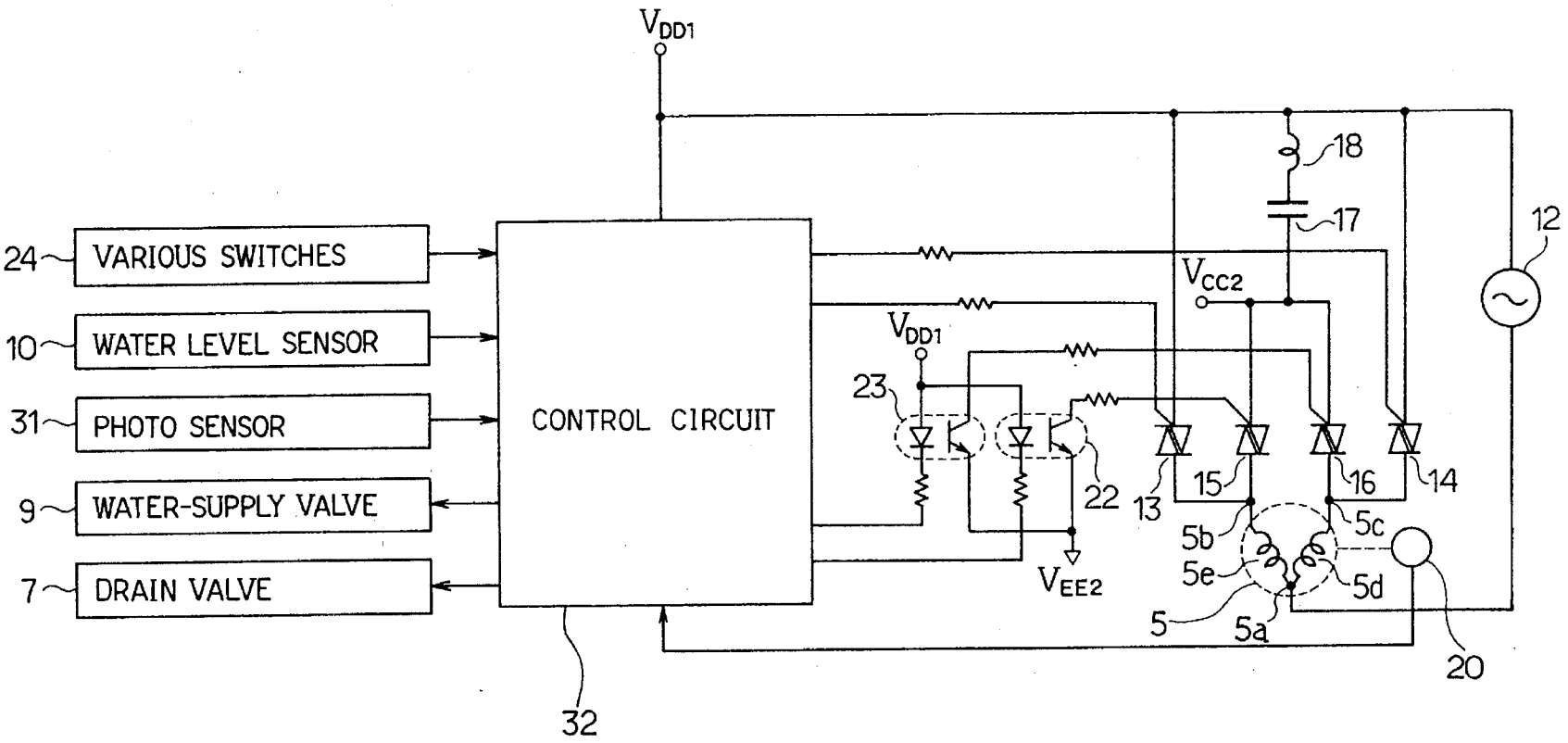
FIG. 6 is a view similar to FIG. 1 showing a second embodiment of a full automatic washing machine.

The rinse operation control means will be described. The control circuit 21 is designed to execute as the rinse operation either a stored-water rinse wherein the clothes are rinsed with water being stored in the rotatable tub 3 or a rinse-with-dehydration wherein the clothes are rinsed and dehydrated with the water being supplied into the rotatable tub 3. In the stored-water rinse, the water-supply valve 9 is opened with the drain valve 7 closed. Water is then supplied into the rotatable tub 3 so that a predetermined water level is reached. Consequently, a predetermined amount of water is stored in the rotatable tub 3. The motor 5 is energized in the first energization mode wherein all the coils are energized, so that the agitator 4 is rotated in the forward and reverse directions alternately repeatedly, whereby the clothes are rinsed. On the other hand, the drain valve 7 is opened in the rinse-with-dehydration. The water-supply valve 9 is also opened so that the water is supplied into the rotatable tub 3. The motor 5 is then driven so that the rotatable tub 3 is rotated with simultaneous dehydrating operation. In the embodiment, the energization mode of the motor 5 is switched so that the rotational speed of the rotatable tub 3 is increased from 60 to 300, 450, 600 and 800 r.p.m. sequentially in this order, as shown in FIG. 4. These rotational speeds have respective predetermined periods. In this speed control, the energization mode of the motor 5 is switched among the modes as shown in TABLE 1 on the basis of the detection signal from the rotational speed detecting means so that the above-mentioned speeds are maintained. More specifically, the energization mode is switched between the "all coils" and "auxiliary coil" modes in the control of the speeds, 60, 300, 450 and 600 r.p.m. The energization mode is switched between the "all coil" and "main coil" modes in the control of the speed, 800 r.p.m. The water supply into the rotatable tub 3 in the rinse-with-dehydration is performed while the rotational speed of the rotatable tub 3 is maintained at a low speed range, for example, at 60 r.p.m. Furthermore, a period of the water supply per execution of the rinse-with-dehydration is set on the basis of the volume of the clothes, as shown in FIG. 3. More specifically, the water-supply period is set for a range between 68 and 54 seconds when the clothes volume ranges between 5 and 4.1 kg. The water-supply period is set for a range between 72 and 36 seconds when the clothes volume ranges between 4 and 2.1 kg. The water-supply period is set for a range between 54 and 27 seconds when the clothes volume ranges between 2 and 1 kg. An amount of water supplied into the rotatable tub 3 is also set when the water-supply period is set as described above. The control circuit 21 thus serves as supplied water amount setting means. The water-supply period relates to the number of times of execution of the rinse-with-dehydration and the relation will be described later.

Operation mode selecting means and repeat times setting means will be described. FIG. 3 shows control patterns of the rinse operation performed after completion of the wash operation. One of the control patterns is set in accordance with the result of detection of the clothes volume. More specifically, a control pattern A is selected when the detected clothes volume ranges from 6 to 5.1 kg. The control pattern A includes operations of the wash, drainage, intermediate dehydration, first stored-water rinse, drainage, intermediate dehydration, second stored-water rinse, drainage and final dehydration sequentially performed in this order. The stored-water rinse mode is automatically selected in the control pattern A. A control pattern B1 is selected when the detected clothes volume ranges from 5 to 4.1 kg. The control pattern B1 includes operations of wash, drainage, intermediate dehydration, rinse-with-dehydration at four times, stored-water rinse, drainage and final dehydration sequentially performed in this order. The rinse-with-dehydration mode is automatically selected in the control pattern B1. Since the rinse-with-dehydration mode is selected in the control pattern B1, the second intermediate dehydration is eliminated. The operation of rinse-with-dehydration is executed four times in the control pattern B1. The rotational speed control as shown in FIG. 4 is performed in each rinse-with-dehydration operation. The water-supply period is set for a suitable period in the range between 68 and 54 seconds in accordance with the volume of clothes.

A control pattern B2 is selected when the volume of clothes ranges from 4 to 2.1 kg. The rinse-with-dehydration operation is performed three times in the control pattern B2. The rotational speed control as shown in FIG. 4 is performed in each rinse-with-dehydration operation. The water-supply period is set for a suitable period in the range between 72 and 36 seconds in accordance with the volume of clothes. Since the rinse-with-dehydration operation is performed at three times, the longest water-supply period is rendered longer. However, since the number of times of the water-supply operation is smaller, the total water-supply period is shorter than in the control pattern B1. A control pattern B3 is selected when the volume of clothes ranges from 2 to 1 kg. The rinse-with-dehydration operation is performed twice in the control pattern B3. The rotational speed control as shown in FIG. 4 is performed in each rinse-with-dehydration operation. The water-supply period is set for a suitable period in the range between 54 and 27 seconds in accordance with the volume of clothes.

According to the above-described embodiment, the water-stored rinse mode is automatically selected when the volume of clothes to be washed is large. Consequently, a predetermined rinse effect can be achieved. On the other hand, when the clothes volume is small, that is, when the clothes volume is at a standard or below, the rinse-with-dehydration mode is automatically selected. Consequently, the amount of water used in the rinse operation and the period of the rinse operation can be reduced while the predetermined rinse effect can be achieved. Furthermore, when the rinse-with-dehydration mode has been selected, the number of its repeat times is set on the basis of the result of detection of the clothes volume. Consequently, the amount of water and the period of the rinse operation can be accurately adjusted, which can provide further reduction in the amount of used water and the period of the rinse operation. Additionally, when the rinse-with-dehydration mode has been selected, the water-supply period (amount of supplied water) in the rinse-with-dehydration operation is set on the basis of the result of detection of the clothes volume. Consequently, further reduction in the amount of used water and the period of the rinse operation can be achieved.

TABLES 2 and 3 show reduction in the amount of water and the period of rinse operation achieved in the embodiment in comparison with the prior art.

TABLE 2

| Clothes volume (kg) | Rinse-with-dehydration (min.) | Water-stored rinse (min.) | Effect (%) |
|---|---|---|---|
| 5 to 4.1 | 26.5 to 25.7 | 26.8 | 1 to 4 |
| 4 to 3.1 | 25.6 to 22.7 | 26.8 | 4 to 15 |
| 3 to 2.1 | 22.6 to 19.7 | 26.3 | 14 to 25 |
| 2 to 1 | 19.6 to 16.6 | 20.7 | 5 to 20 |

TABLE 3

| Clothes volume (kg) | Rinse-with-dehydration (l.) | Water-stored rinse (l.) | Present embodiment (l.) | Prior art (l.) | Effect (%) |
|---|---|---|---|---|---|
| 5 to 4.1 | 41 to 50 | 60 | 101 to 110 | 120 | 0 to 16 |
| 4 to 3.1 | 31 to 40 | 67 | 88 to 97 | 114 | 15 to 23 |
| 3 to 2.1 | 21 to 30 | 50 | 71 to 80 | 100 | 20 to 29 |
| 2 to 1 | 10 to 20 | 40 | 50 to 60 | 80 | 25 to 38 |

As obvious from TABLE 2, the period required for washing in the embodiment is shortened as compared with the prior art wherein only the stored-water rinse mode is performed as the rinse operation. In particular, the washing period can be shortened by 14 to 25% when the volume of clothes ranges from 3 to 2.1 kg. On the other hand, TABLE 4 denotes that the amount of water used in the above-described embodiment is smaller than in the prior art wherein only the stored-water rinse mode is executed in the rinse operation. Although the amount of water used in the stored-water rinse mode is changed to some extent according to the volume of clothes in the prior art, the washing operation period and the amount of supplied water can be reduced in the embodiment as compared with the prior art.

Figure 7:
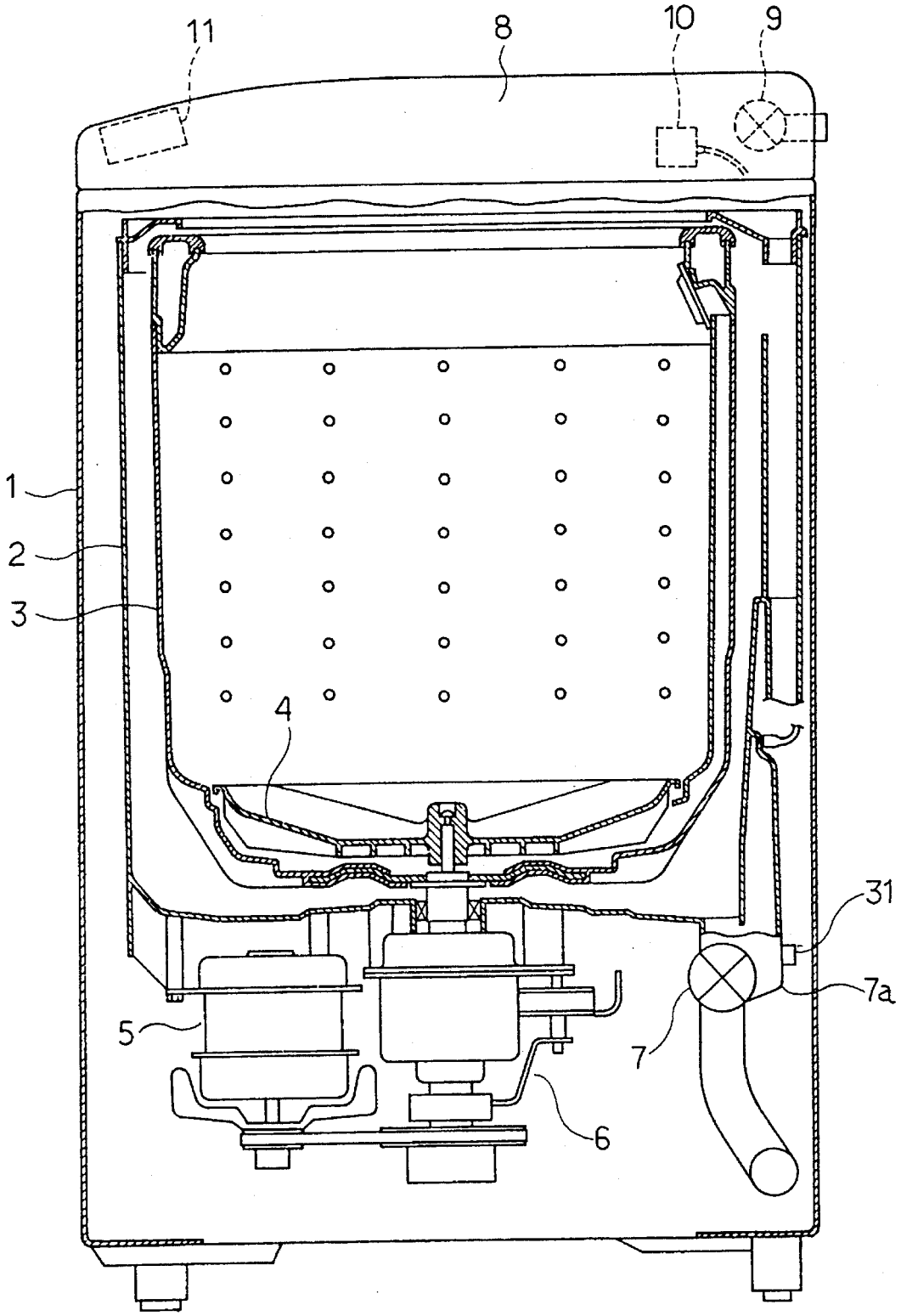
FIG. 7 is a view similar to FIG. 2 showing the second embodiment.

FIGS. 6 to 11 illustrate a second embodiment. Referring first to FIG. 7, a photo sensor 31 serving as soiling degree detecting means is provided in a drain case 7*a* in which the drain valve 7 is also provided. The photo sensor 31 comprises a light-emitting element and a light-detecting element and detects transmittance of the wash liquid flowing into the drain case 7*a* from the water-receiving tub 2, thereby detecting turbidity of the wash liquid, that is, the degree of soiling of the clothes. A detection signal generated by the photo sensor 31 is supplied to a control circuit 32. The control circuit 32 serves as rotational speed setting means as well as the clothes volume detecting means, the rinse operation control means, the operation mode selecting means and the supplied water amount setting means.

These functions of the control circuit 32 will be described. Since the clothes volume detecting means and the rinse operation control means can be understood readily from the first embodiment, detailed description of these functions will be eliminated. In detection of the volume of clothes, the volume is divided into "LARGE," "MIDDLE" and "SMALL" as shown in the following TABLE 4:

TABLE 4

| Volume of clothes | Degree of soiling | | |
|---|---|---|---|
| | HIGH | MIDDLE | LOW |
| LARGE | Stored-water rinse | Stored-water rinse | Water-supply valve: turn-on for 5 sec. and turn-off for 5 sec. Water-supply period: long Rotational speed: 300 r.p.m. |
| MIDDLE | Stored-water rinse | Stored-water rinse | Water-supply valve: turn-on for 3 sec. and turn-off for 5 sec. Water-supply period: middle Rotational speed: 400 r.p.m. |
| SMALL | Water-supply valve: turn-on for 5 sec. and turn-off for 5 sec. Water-supply period: long Rotational speed: 500 r.p.m. | Water-supply valve: turn-on for 3 sec. and turn-off for 5 sec. Water-supply period: middle Rotational speed: 500 r.p.m. | Water supply valve: turn-on for 2 sec. and turn-off for 5 sec. Water-supply period: short Rotational speed: 500 r.p.m. |

Figure 8:
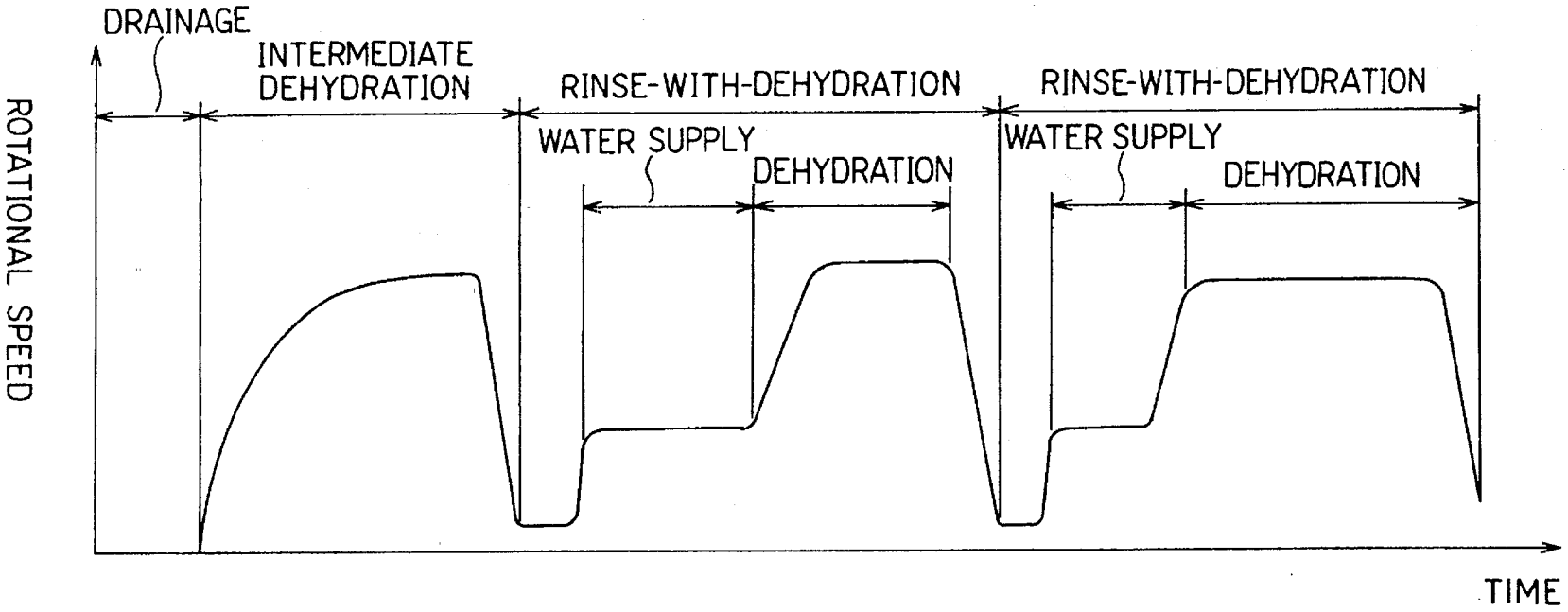
FIG. 8 is a view similar to FIG. 4 showing the second embodiment.
Figure 9:
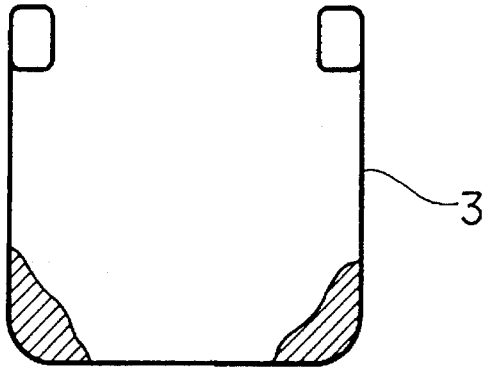
FIG. 9 is a schematic view of the rotatable tub in which a small volume of clothes is accommodated.
Figure 10:
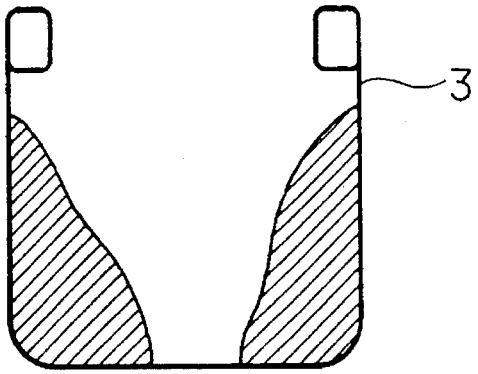
FIG. 10 is also a schematic view of the rotatable tub in which a large volume of clothes is accommodated.

FIG. 8 shows the control contents of the rinse-with-dehydration mode. The rotational speed of the rotatable tub 3 is controlled in a low speed range when the rinse operation accompanies the water-supply operation while it is controlled in a high speed range when the rinse operation does not accompany the water-supply operation. The rotational speed in the high speed range is set on the basis of the results of detection of the clothes volume as will be described later.

The control circuit 32 detects the turbidity of the wash liquid or the degree of soiling of the clothes in one of the three ranks as shown in TABLE 4 on the basis of the detection signal from the photo sensor 31 in the course of the wash operation. The stored-water rinse mode is automatically selected in the case where the soiling degree is in the rank of HIGH or MIDDLE when the volume of clothes is LARGE. More specifically, as shown in FIG. 11, first and second stored-water rinse operations are performed in the rinse operation and the rinse-with-dehydration operation is not performed. Furthermore, the rinse-with-dehydration operation is performed instead of the first stored-water rinse operation in the case where the soiling degree is LOW when the volume of clothes is LARGE. In the rinse-with-dehydration, the water-supply valve 9 is opened for five seconds and closed for five seconds alternately repeatedly so that an intermittent water-supply is performed, as shown in TABLE 4. The water-supply period is set for LONG and the rotational speed of the rotatable tub 3 during the time of water-supply is set for 300 r.p.m.

On the other hand, when the soiling degree is HIGH or MIDDLE with the clothes volume in the level of MIDDLE, the stored-water rinse mode is automatically selected. The rinse-with-dehydration mode is automatically selected when the soiling degree is LOW. In the rinse-with-dehydration mode, the water-supply valve 9 is opened for three seconds and closed for five seconds alternately repeatedly so that the intermittent water-supply is performed, as shown in TABLE 4. The water-supply period is set for MIDDLE and the rotational speed is set for 400 r.p.m. The rinse-with-dehydration mode is automatically selected when the soiling degree is any one of HIGH, MIDDLE and LOW with the clothes volume in the level of SMALL. In this case, when the soiling degree is HIGH, the water-supply valve 9 is opened for five seconds and closed for five seconds alternately repeatedly so that the intermittent water-supply is performed, as shown in TABLE 4. The water-supply period is set for LONG and the rotational speed is set for 500 r.p.m. When the soiling degree is MIDDLE, the water-supply valve 9 is opened for three seconds and closed for five seconds alternately repeatedly so that the intermittent water-supply is performed. The water-supply period is set for MIDDLE and the rotational speed is set for 500 r.p.m. Additionally, when the soiling degree is LOW, the water-supply valve 9 is opened for two seconds and closed for five seconds alternately repeatedly so that the intermittent water-supply is performed. The water-supply period is set for SHORT and the rotational speed is set for 500 r.p.m.

The control circuit 32 then sets the rotational speed of the rotatable tub 3 during the water supply in the rinse-with-dehydration operation in accordance with the results of detection of the clothes volume. The control circuit 32 further sets the periods of open and closed states of the water-supply valve 9 or the on-off duty thereof in accordance with the results of detection of the clothes volume, thereby setting the amount of supplied water. This control manner will be described in more detail. Consider now the case where the rinse-with-dehydration operation is to be performed when the volume of clothes is small. In this case, the water penetrates sufficiently into the inside clothes even when the rotatable tub 3 is rotated at high speeds during the water supply in the rinse-with-dehydration operation, as obvious from FIG. 9. On the other hand, when the volume of clothes is large, the water penetrates into the inside clothes when the rotatable tub 3 is rotated at low speeds rather than at the high speeds. Furthermore, since an amount of used detergent is larger when the soiling degree is HIGH, the amount of supplied water is increased so that the clothes are rinsed sufficiently. However, since the amount of detergent is smaller when the soiling degree is LOW, a sufficient rinsing effect is achieved even when the amount of supplied water is set for a small value.

According to the second embodiment, the stored-water rinse mode is automatically selected when the soiling degree is high, so that an expected rinsing effect can be achieved. When the soiling degree is low, the rinse-with-dehydration mode is automatically selected. Consequently, both the reduction in the amount of used water and the shortening of the washing period can be achieved while the predetermined level of the rinsing effect is maintained. Furthermore, when the rinse-with-dehydration mode is selected, the amount of supplied water is set on the basis of the results of detection of the soiling degree of the clothes. Consequently, the amount of used water and the water-supply period can be adjusted more accurately, which can provide for further reduction in the amount of used water and shortening of the water-supply period. Additionally, the rotational speed of the rotatable tub 3 at the time of the water supply during the rinse-with-dehydration operation is set on the basis of the results of detection of the clothes volume when the rinse-with-dehydration mode is selected. Consequently, the rinsing effect can be maintained at a higher level.

Figure 12:
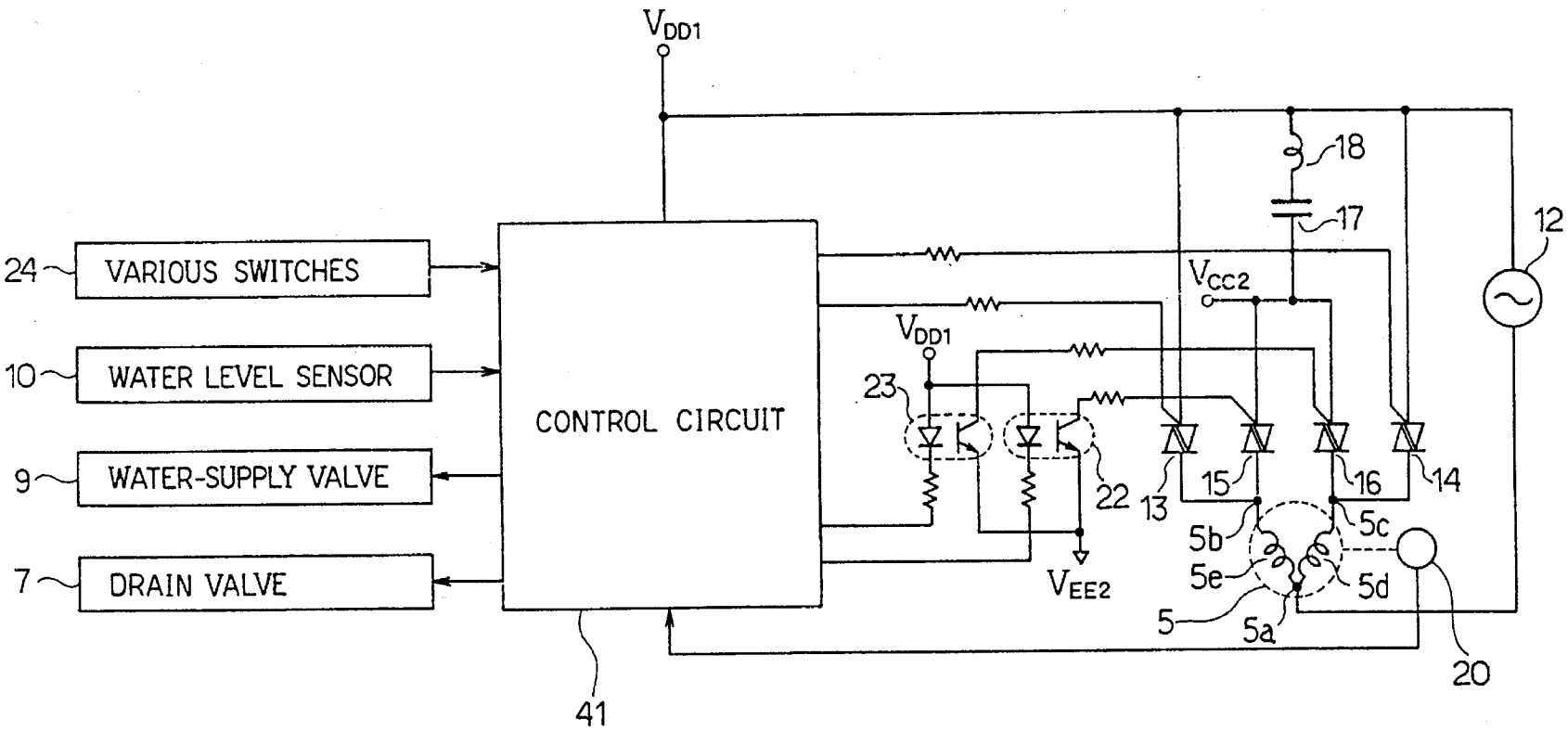
FIG. 12 is a view similar to FIG. 1 showing a third embodiment of a full automatic washing machine.
Figure 13:
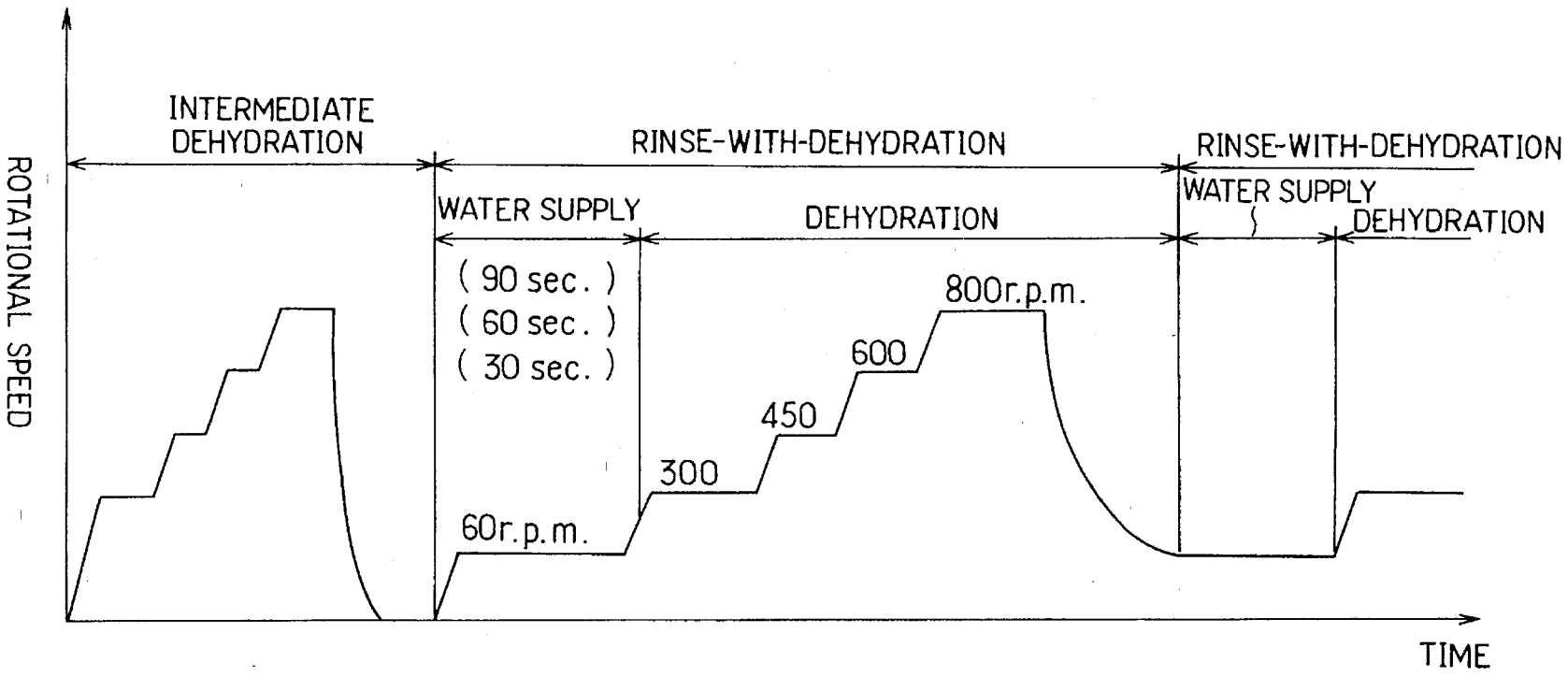
FIG. 13 is a view similar to FIG. 4 showing the third embodiment.
Figure 14:
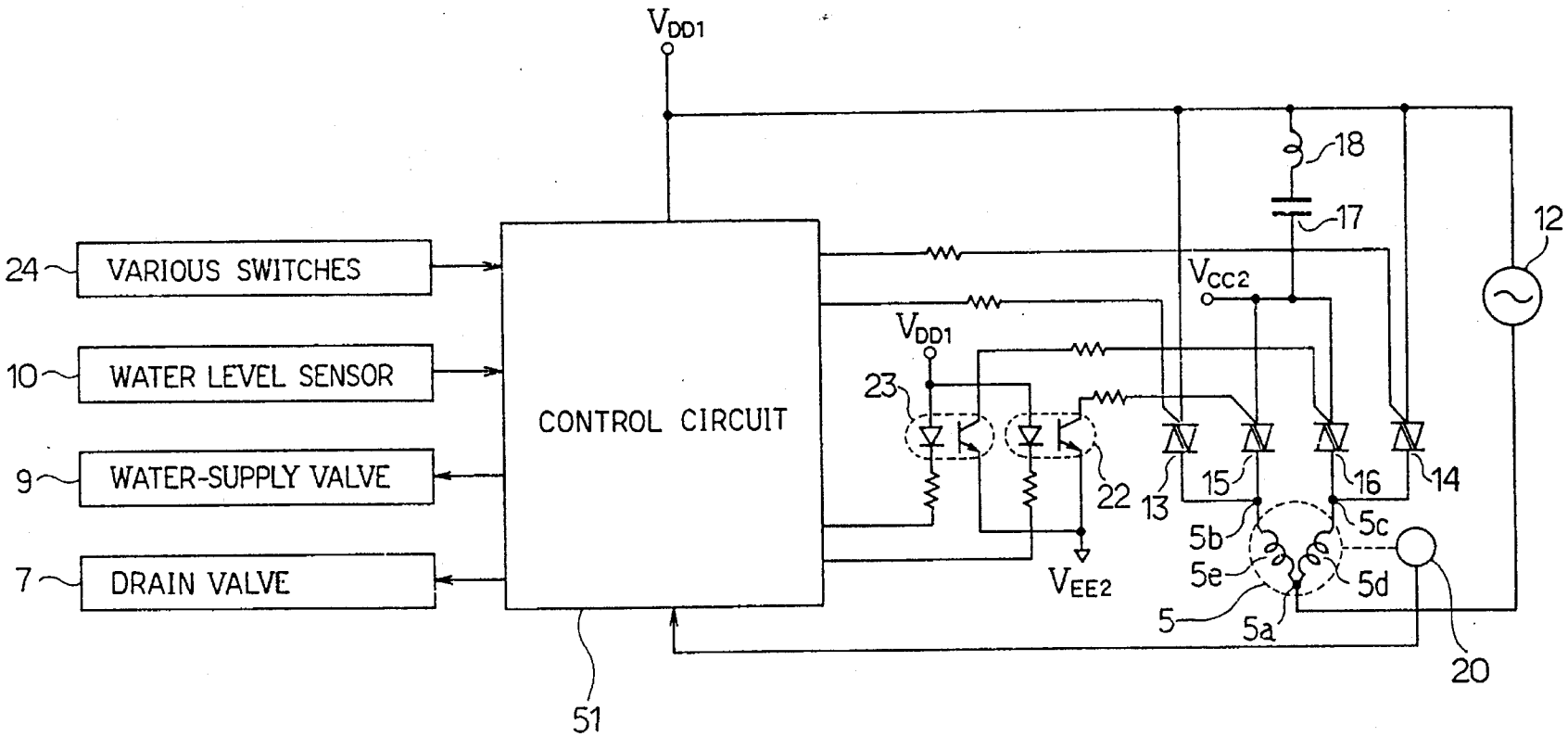
FIG. 14 is a view similar to FIG. 1 showing a fifth embodiment of a full automatic washing machine.

FIGS. 12 and 13 illustrate a third embodiment. Difference between the first and third embodiments will be described. A control circuit 41 employed for the control circuit 21 further serves as water-supply flow rate detecting means for detecting a flow rate of water supplied into the rotatable tub per unit period and water-supply control means setting a time period of the water supplying operation during the rinse-with-dehydration operation in accordance with the results of detection of the water-supply flow rate detecting means. The control circuit 41 detects variation of the water level detected by the water level sensor 10 during a predetermined period when the water is supplied into the rotatable tub 3 for the wash operation, thereby detecting a flow rate of the supplied water per unit period. In this case, the flow rate is detected in three levels of LOW, STANDARD and HIGH. The water-supply period is selected in accordance with the detected water flow rate when the water is supplied into the rotatable tub 3 in the rinse-with-dehydration operation, as shown in FIG. 13. The following TABLE 5 shows the set water-supply periods.

TABLE 5

| Water-supply flow rate | Water-supply time period |
|---|---|
| LOW | 90 sec. |
| STANDARD | 60 sec. |
| HIGH | 40 sec. |

According to the third embodiment, the water-supply flow rate is detected so that the pressure of water from the water supply can be determined. The water-supply time period in the rinse-with-dehydration operation is set on the basis of the results of detection of the water-supply flow rate. Accordingly, the amount of water supplied in the rinse-with-dehydration operation can be controlled to be a proper amount even if the water pressure of the water supply differs from one region to another or varies in time zones in one day. Consequently, insufficiency in the rinse operation and an excessive supply of water can be prevented such that a sufficient rinsing effect can be achieved by use of a proper amount of water.

Although the water-supply time period is set on the basis of the results of detection of the amount of supplied water in the third embodiment, it may be set as shown as a fourth embodiment in the following TABLE 6:

TABLE 6

| Water-supply flow rate | Water-supply time period |
|---|---|
| LOW | Continuous water supply mode |
| STANDARD | Intermittent water supply mode (water supply for 6 sec. and interruption of 3 sec.) |
| HIGH | Intermittent water supply mode (water supply for 5 sec. and interruption of 4 sec.) |

In the fourth embodiment, the water-supply time period is set for a fixed value, for example, 90 sec. and the water-supply pattern is changed in accordance with the results of detection of the water-supply flow rate. More specifically, a continuous water-supply mode is selected as the water-supply pattern when the water-supply flow rate is LOW. An intermittent water-supply mode is selected when the water-supply flow rate is STANDARD. In this water-supply mode, the water supply is performed for six seconds and interrupted for four seconds alternately repeatedly. When the water-supply flow rate is HIGH, the intermittent water-supply mode is also selected so that the water supply is performed for five seconds and interrupted for four seconds alternately repeatedly.

According to the fourth embodiment, either the continuous water-supply mode or the intermittent water-supply mode is selected as the water-supply pattern in the rinse-with-dehydration operation in accordance with the results of detection of the water-supply flow rate. Furthermore, the water-supply pattern is changed in the intermittent water-supply mode. The total amount of supplied water can be controlled to be neither too much nor too less while the required water-supply time period is maintained at an approximately fixed value. Consequently, insufficiency in the rinse and excessive water supply can be prevented and a sufficient rinsing effect can be achieved with use of a proper amount of water.

FIGS. 14 to 17 illustrate a fifth embodiment. The control circuit 21 in the first embodiment serves as the clothes volume detecting means, the rinse operation control means and the operation mode selecting means. A control circuit 51 in the fifth embodiment serves additionally as cloth quality determining means, repeat times setting means, supplied water amount setting means and rotational speed setting means.

The cloth quality determining means will first be described. Upon detection of the clothes volume, the control circuit 51 operates to intermittently drive the motor 5 in the all-coil-energization mode to detect the rotational speeds in the respective drive periods on the basis of the signals from the rotational speed detecting means 20. The control circuit 51 is designed to determine that the clothes are stiff as in the case of jeans, when the rotational speed varies widely. The control circuit 51 further determines that the clothes are soft as in the case of lingerie, when the variation in the rotational speed is small. The control circuit 51 further determines that the clothes are in a STANDARD quality, when the variation in the motor speed is in an intermediate range.

The repeat times setting means will be described. Upon determination of the cloth quality of the clothes as described above, the control circuit 51 sets the number of times of repeat of the rinse-with-dehydration operation on the basis of the results of determination of the cloth quality. More specifically, the number of repeat times is set for "four" in the case where the clothes are STIFF or STANDARD when the clothes volume is in the range of 4 to 3.1 kg. When the clothes are SOFT, the number of repeat times is set for "three."

The supplied water amount setting means will now be described. Upon determination of the cloth quality, the control circuit 51 sets an amount of supplied water in the rinse-with-dehydration operation in accordance with the results of determination of the cloth quality, as shown in the following TABLE 7:

TABLE 7

| Volume of clothes (kg) | Cloth quality | Rinse-with-Dehydration (l.) | Stored-water rinse (l.) | Embodiment (l.) | Prior art (l.) | Effect (%) |
|---|---|---|---|---|---|---|
| 5 to 4.1 | STIFF | 41 to 60 | 60 | 101 to 120 | 120 | 0 to 16 |
| | STANDARD | | | | | |
| | SOFT | 26 to 37 | | 86 to 97 | | 19 to 28 |
| 4 to 3.1 | STIFF | 31 to 40 | 57 | 88 to 97 | 114 | 15 to 23 |
| | STANDARD | | | | | |
| | SOFT | 20 to 25 | | 77 to 82 | | 28 to 32 |
| 3 to 2.1 | STIFF | 21 to 30 | 50 | 71 to 80 | 100 | 20 to 29 |
| | STANDARD | | | | | |
| | SOFT | 13 to 19 | | 63 to 69 | | 31 to 37 |
| 2 to 1 | STIFF | 10 to 20 | 40 | 50 to 60 | 80 | 25 to 38 |
| | STANDARD | | | | | |
| | SOFT | 6 to 12 | | 46 to 50 | | 35 to 43 |

Referring to TABLE 7, the amount of supplied water is set for the range of 31 to 40 litters in the case where the clothes are STIFF or STANDARD when the clothes volume is in the range of 4 to 3.1 kg. When the clothes are SOFT, the amount of supplied water is set for the range of 20 to 25 litters. In the embodiment, additionally, the amount of supplied water is also set in accordance with the results of determination of the cloth quality as described above when the stored-water rinse is selected. Since the flow rate of the water supplied from the water supply per unit time period can be estimated to some extent, the amount of supplied water can be controlled by control of the water-supply time period. Furthermore, the water-supply flow rate per unit time period may be detected by the water-supply flow rate detecting means as described in the third embodiment so that the water-supply time period is controlled on the basis of the results of detection of the water-supply flow rate for the control of the amount of supplied water.

Figure 16:
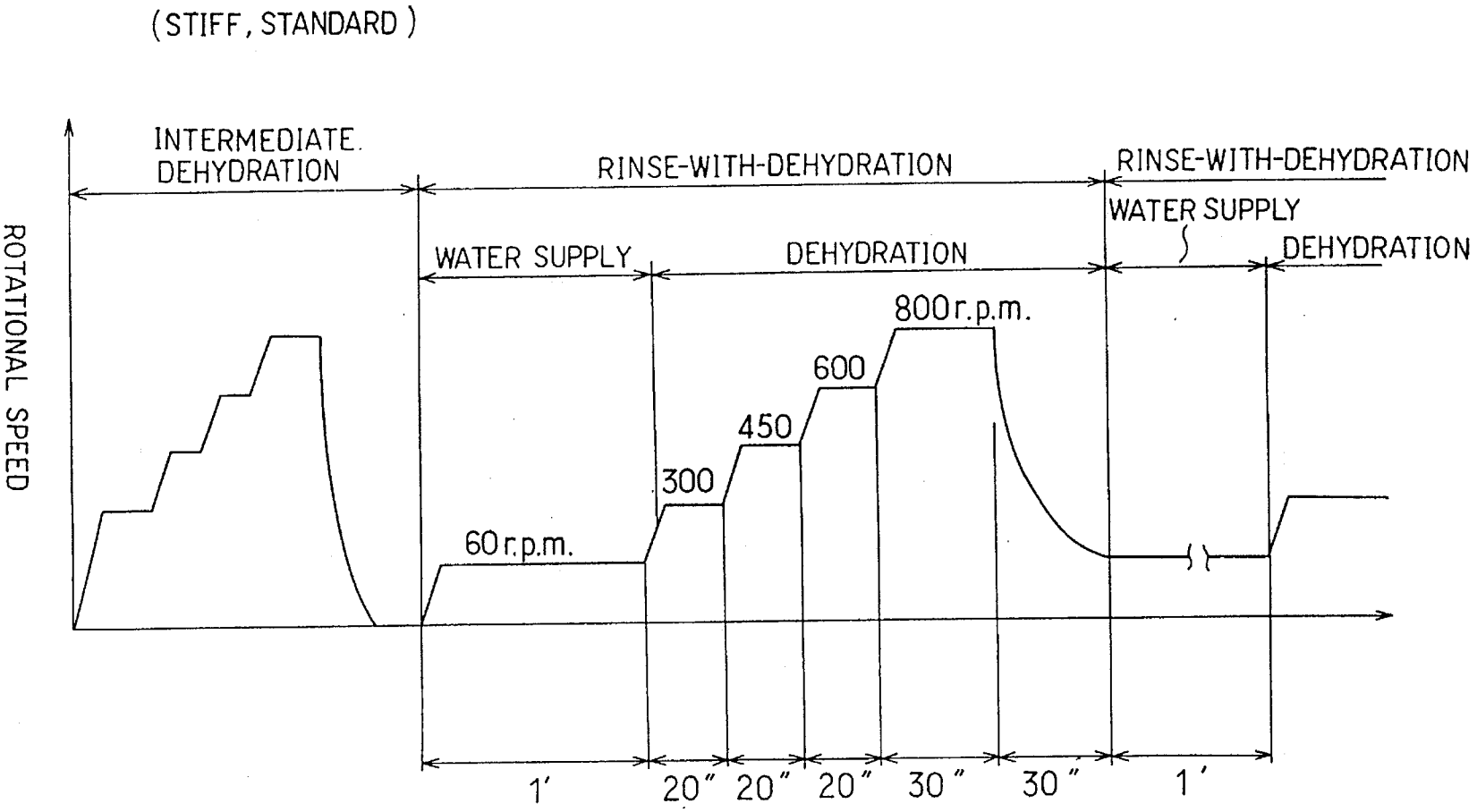
FIG. 16 is a view similar to FIG. 4 showing the fifth embodiment.
Figure 17:
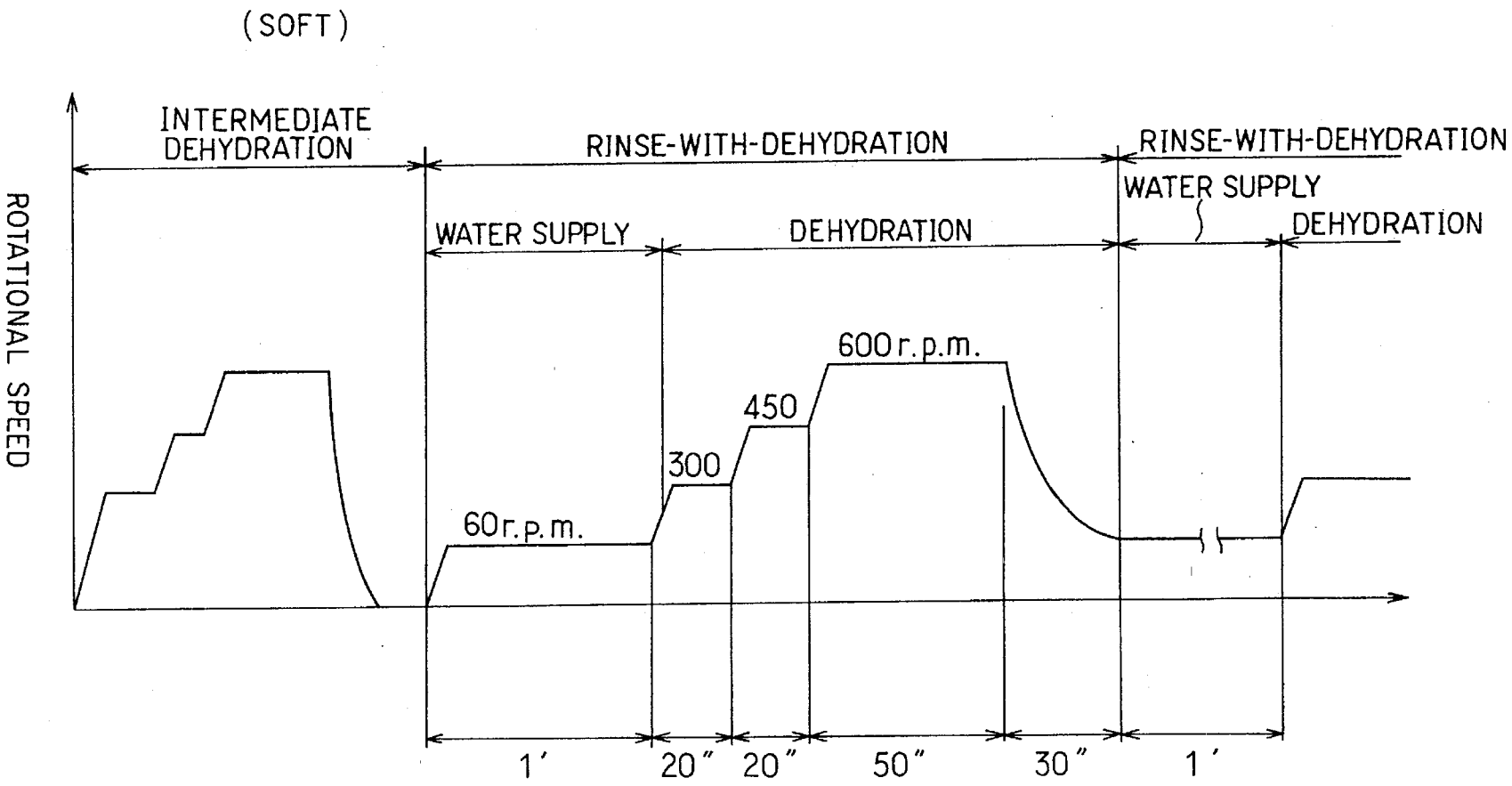
FIG. 17 is also a view similar to FIG. 4 showing the fifth embodiment.

The rotational speed setting means will then be described. Upon determination of the cloth quality, the control circuit 51 sets the rotational speed of the rotatable tub 3 in the rinse-with-dehydration operation in accordance with the results of determination of the cloth quality, as shown in FIGS. 16 and 17. The rotational speed of the rotatable tub 3 is set to be increased from 300, 450, 600 to 800 r.p.m. sequentially in this order when the clothes are STIFF or STANDARD. These rotational speeds have respective time periods as shown in FIG. 16. On the other hand, when the clothes are SOFT, the rotational speed of the rotatable tub 3 is controlled so that the maximum speed does not exceed 600 r.p.m., as shown in FIG. 17.

According to the fifth embodiment, the number of repeat times of the rinse-with-dehydration operation is set in accordance with the cloth quality, so that the rinse-with-dehydration operation can be executed at the number of times suitable for the cloth quality. Consequently, the washing time period can be shortened. Furthermore, since the amount of supplied water is set in accordance with the cloth quality, the rinse-with-dehydration operation can be executed with the amount of supplied water suitable for the cloth quality. Consequently, a sufficient rinsing effect can be achieved and the water can be saved. Additionally, since the rotational speed of the rotatable tub is set in accordance with the cloth quality, the rotatable tub can be rotated at the speed suitable for the cloth quality in the rinse-with-dehydration operation and accordingly, the rotatable tub can be prevented from being rotated at excessively high speeds, which results in saving of electric power.

FIG. 18 illustrates a sixth embodiment. Difference between the fifth and sixth embodiments will be described. In the sixth embodiment, the stored-water rinse mode is automatically selected in the case where the cloth quality is STIFF or STANDARD, when the clothes volume is in the range of 6 to 41.1 kg. Otherwise, the rinse-with-dehydration mode is automatically selected. The rinsing is likely to be insufficient when the volume of clothes which are STIFF or STANDARD in the cloth quality is large. In such a case, however, a sufficient rinsing effect can be achieved in the above-described control manner. The other arrangement is the same as in the fifth embodiment.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A full automatic washing machine comprising an outer tub, a rotatable tub rotatably mounted in the outer tub, an agitator rotatably mounted in the rotatable tub and an electric motor for driving the rotatable tub and the agitator, the full automatic washing machine further comprising:

a) clothes volume detecting means for detecting volume of clothes accommodated in the rotatable tub;

b) rinse control means for controlling either a stored-water rinse mode wherein the clothes are rinsed with water being stored in the rotatable tub or a rinse-with-dehydration mode wherein the clothes are rinsed and dehydrated with the water supplied into the rotatable tub; and c) operation mode selecting means for selecting the stored-water rinse mode when the volume of clothes detected by the clothes volume detecting means is large or the rinse-with-dehydration mode when the volume of clothes detected by the clothes volume detecting means is small.

2. A full automatic washing machine comprising an outer tub, a rotatable tub rotatably mounted in the outer tub, an agitator rotatably mounted in the rotatable tub and an electric motor for driving the rotatable tub and the agitator, the full automatic washing machine further comprising:

a) soiling degree detecting means for detecting a degree of soiling of the clothes accommodated in the rotatable tub;

b) rinse control means for controlling either a stored-water rinse mode wherein the clothes are rinsed with water being stored in the rotatable tub or a rinse-with-dehydration mode wherein the clothes are rinsed and dehydrated with the water being supplied into the rotatable tub; and c) operation mode selecting means for selecting the stored-water rinse mode when the degree of soiling of the clothes detected by the soiling degree detecting means is large or the rinse-with-dehydration mode when the degree of soiling of the clothes detected by the clothes volume detecting means is small.

3. A full automatic washing machine comprising an outer tub, a rotatable tub rotatably mounted in the outer tub, an agitator rotatably mounted in the rotatable tub and an electric motor for driving the rotatable tub and the agitator, the full automatic washing machine further comprising:

a) clothes volume detecting means for detecting volume of clothes accommodated in the rotatable tub;

b) soiling degree detecting means for detecting a degree of soiling of the clothes accommodated in the rotatable tub;

c) rinse control means for controlling either a stored-water rinse mode wherein the clothes are rinsed with water being stored in the rotatable tub or a rinse-with-dehydration mode wherein the clothes are rinsed and dehydrated with the water supplied into the rotatable tub; and d) operation mode selecting means for selecting either the stored-water rinse mode or the rinse-with-dehydration mode on the basis of results of detection of the clothes volume detecting means and the soiling degree detecting means.

4. A full automatic washing machine according to claim 1 or 3, further comprising repeat times setting means for setting the number of times of repeat of a rinse-with-dehydration operation on the basis of the results of detection of the clothes volume detecting means when the rinse-with-dehydration mode is selected by the operation mode selecting means.

5. A full automatic washing machine according to claim 2 or 3, further comprising repeat times setting means for setting the number of times of repeat of a rinse-with-dehydration operation on the basis of the results of detection of the soiling degree detecting means when the rinse-with-dehydration mode is selected by the operation mode selecting means.

6. A full automatic washing machine according to claim 1 or 3, further comprising supplied water amount setting means for setting an amount of water supplied for a rinse-with-dehydration operation on the basis of the results of detection of the clothes volume detecting means when the rinse-with-dehydration mode is selected by the operation mode selecting means.

7. A full automatic washing machine according to claim 2 or 3, further comprising supplied water amount setting means for setting an amount of water supplied for a rinse-with-dehydration operation on the basis of the results of detection of the soiling degree detecting means when the rinse-with-dehydration mode is selected by the operation mode selecting means.

8. A full automatic washing machine according to claim 1, 2 or 3, wherein the rinse control means controls the water supply in a rinse-with-dehydration operation so that the water is supplied into the rotatable tub while a rotational speed of the rotatable tub is in a low dehydration speed range.

9. A full automatic washing machine according to claim 1, 2 or 3, wherein the rinse control means controls a rotational speed of the rotatable tub in a rinse-with-dehydration operation so that the rotational speed of the rotatable tub is successively increased from a low speed to a high speed.

10. A full automatic washing machine according to claim 1 or 3, further comprising rotational speed setting means for setting a rotational speed of the rotatable tub at the time of the water supply during a rinse-with-dehydration operation on the basis of the results of detection of the clothes volume detecting means when the rinse-with-dehydration mode is selected by the operation mode selecting means.

11. A full automatic washing machine according to claim 2 or 3, further comprising rotational speed setting means for setting a rotational speed of the rotatable tub at the time of the water supply during a rinse-with-dehydration operation on the basis of the results of detection of the soiling degree detecting means when the rinse-with-dehydration mode is selected by the operation mode selecting means.

12. A full automatic washing machine according to claim 1, 2 or 3, further comprising water-supply flow rate detecting means for detecting a flow rate of water supplied into the rotatable tub per unit period and water-supply control means setting a time period of a water supplying operation during a rinse-with-dehydration operation in accordance with the results of detection of the water-supply flow rate detecting means.

13. A full automatic washing machine according to claim 1, 2 or 3, further comprising water-supply flow rate detecting means for detecting a flow rate of water supplied into the rotatable tub per unit period and water-supply control means selecting either a pattern of a continuous water-supply mode or a pattern of an intermittent water-supply mode wherein the water-supply mode is changed, in a rinse-with-dehydration operation in accordance with the results of detection of the water-supply flow rate detecting means.

14. A full automatic washing machine according to claim 1, further comprising cloth quality determining means for determining cloth quality of the clothes accommodated in the rotatable tub and repeat times setting means for setting the number of times of repeat of a rinse-with-dehydration operation on the basis of the results of determination of the cloth quality determining means.

15. A full automatic washing machine according to claim 1, further comprising cloth quality determining means for determining cloth quality of the clothes accommodated in the rotatable tub and supplied water amount setting means for setting an amount of water supplied for a rinse-with-dehydration operation on the basis of the results of determination of the cloth quality determining means.

16. A full automatic washing machine according to claim 1, further comprising cloth quality determining means for determining cloth quality of the clothes accommodated in the rotatable tub and rotational speed setting means for setting a rotational speed of the rotatable tub at the time Of a dehydrating operation during a rinse-with-dehydration operation on the basis of the results of determination of the cloth quality determining means.

17. A full automatic washing machine, comprising:

an outer tub;

a rotatable tub rotatably mounted in the outer tub;

an agitator rotatably mounted in the rotatable tub;

an electric motor for driving the rotatable tub and the agitator;

rinse control means for controlling either a stored-water rinse mode wherein clothes accommodated in the rotatable tub are rinsed with water being stored in the rotatable tub or a rinse-with-dehydration mode wherein the clothes are rinsed and dehydrated with the water being supplied into the rotatable tub; and operation mode selecting means for automatically selecting either the stored-water rinse mode or the rinse-with-dehydration mode on the basis of data on the status of the clothes, which data is obtained during execution of a wash step and includes a volume, a degree of soiling or a cloth quality of the clothes.

* * * * *